US011137788B2

(12) United States Patent
Panja et al.

(10) Patent No.: US 11,137,788 B2
(45) Date of Patent: Oct. 5, 2021

(54) SUB-BANDGAP COMPENSATED REFERENCE VOLTAGE GENERATION CIRCUIT

(71) Applicant: STMicroelectronics International N.V., Schiphol (NL)

(72) Inventors: Pijush Kanti Panja, West Bengal (IN); Gautam Dey Kanungo, Delhi (IN)

(73) Assignee: STMicroelectronics International N.V., Schiphol (NL)

( * ) Notice: Subject to any disclaimer, the term of this patent is extended or adjusted under 35 U.S.C. 154(b) by 13 days.

(21) Appl. No.: 16/558,717

(22) Filed: Sep. 3, 2019

(65) Prior Publication Data

US 2020/0073430 A1 Mar. 5, 2020

Related U.S. Application Data

(60) Provisional application No. 62/726,564, filed on Sep. 4, 2018.

(51) Int. Cl.
*G05F 3/26* (2006.01)

(52) U.S. Cl.
CPC ..... *G05F 3/267* (2013.01)

(58) Field of Classification Search
None
See application file for complete search history.

(56) References Cited

U.S. PATENT DOCUMENTS 8,816,756 B1 * 8/2014 Eberlein ..... G05F 3/30 327/539
2009/0160537 A1 * 6/2009 Marinca ..... G05F 3/30 327/539

(Continued)

FOREIGN PATENT DOCUMENTS

CN 102789254 A 11/2012
CN 106774592 A 5/2017
CN 210691139 U 6/2020

OTHER PUBLICATIONS

Sun, Na and Sobot, Robert: "A Low-Power Low-Voltage Bandgap Reference in CMOS," Department of Electrical and Computer Engineering, The University of Western Ontario, London ON, Canada, May 2010 (5 pages).

(Continued)

*Primary Examiner* — Jeffrey A Gblende
(74) *Attorney, Agent, or Firm* — Crowe & Dunlevy

(57) ABSTRACT

A sub-bandgap reference voltage generator includes a reference current generator generating a reference current (proportional to absolute temperature), a voltage generator generating an input voltage (proportional to absolute temperature) from the reference current, and a differential amplifier. The differential amplifier is biased by the reference current and has an input receiving the input voltage and a resistor generating a voltage proportional to absolute temperature summed with the input voltage to produce a temperature insensitive output reference voltage. The reference current generator may generate the reference current as a function of a difference between bias voltages of first and second transistors. The voltage generator may generate the input voltage by applying the current proportional to absolute temperature through a plurality of transistors coupled in series between the bias voltage of the second transistor and ground, and tapping a node between given adjacent ones of the plurality of transistors.

22 Claims, 2 Drawing Sheets

(56) References Cited

U.S. PATENT DOCUMENTS

| | | | | |
|---|---|---|---|---|
| 2009/0243713 | A1* | 10/2009 | Marinca | G05F 3/30 327/542 |
| 2010/0201406 | A1* | 8/2010 | Illegems | G05F 3/242 327/109 |
| 2019/0113946 | A1* | 4/2019 | Nicollini | G05F 3/265 |

OTHER PUBLICATIONS

Nararro, Joao and Ishibe, Eder: "A Simple CMOS Bandgap Reference Circuit with Sub-1-V Operation," 2011 IEEE, pp. 2289-2292.
Lee, Chu-Liang et al: "A Low Power Bandgap Voltage Reference for Low-Dropout Regulator," 2015 IEEE (4 pages).
First Office Action and Search Report for co-pending CN Appl. No. 201910834152.4 dated Mar. 15, 2021 (10 pages).

* cited by examiner

SUB-BANDGAP COMPENSATED REFERENCE VOLTAGE GENERATION CIRCUIT

RELATED APPLICATION

This application claims priority to United States Provisional Application for Patent No. 62/726,564, filed Sep. 4, 2018, the contents of which are incorporated by reference to the maximum extent allowable under the law.

TECHNICAL FIELD

This disclosure is related to the field of temperature independent reference voltage generation, and in particular, to a circuit for generating a temperature independent reference voltage that is a fraction of a generated bandgap voltage.

BACKGROUND

Integrated circuit technology offers no reference voltages that are inherently constant regardless of temperature variations. Therefore, a practical way of generating a temperature independent reference voltage is by combining two voltages with precisely complementary temperature behavior. By adding a voltage that increases with temperature (e.g., proportional to absolute temperature) to one that decreases with temperature (e.g., complementary to absolute temperature), provided that the slopes of these voltages are equal in magnitude but opposite in sign, the result will be a voltage that is independent of temperature.

A common circuit used to generate such a temperature independent reference voltage is called a "bandgap voltage generator", which typically has an output voltage around 1.25 V (which is close to the theoretical 1.22 eV bandgap of silicon at 0 K, hence the name "bandgap voltage" generator).

In some instances, however, it may be desirable to generate a temperature independent reference voltage that is but a fraction of the bandgap voltage. This can be referred to as a sub-bandgap reference voltage.

For example, one known sub-bandgap reference voltage generator is described in "A Low-power Low-voltage Bandgap Reference in CMOS", by N. Sun and R. Sobot, published in Electrical and Computer Engineering, 2010, at the 23rd Canadian conference on May 2010. This design generates a sub-bandgap reference voltage using compensated current generation implemented with proportional to absolute temperature (PTAT) and complementary to absolute temperature (CTAT) components in parallel. However, this design may experience issues reaching stability upon device startup, and in some instances, the sub-bandgap reference voltage produced may vary slightly.

Another known sub-bandgap reference voltage generator is described in "A simple CMOS bandgap reference circuit with sub 1V operation", by Joao Navarro and Eder Ishibe, published in Circuits and Systems, IEEE International Symposium, 2011. This design generates a sub-bandgap reference voltage by summing PTAT and CTAT currents using a known voltage difference across a resistor. However, the sub-bandgap reference voltage produced is subject to process variations in the resistor, as well as resistance variations of the resistor over temperature.

A further known sub-bandgap reference voltage generator is described in "A low power bandgap voltage reference for Low-Dropout Regulator", by C. L. Lee, R. M. Sidek, F. Z. Rokhani, and N. Sulaiman, published in Micro and Nanoelectronics 2015 IEEE Regional Symposium, 2015. This design generates the sub-bandgap reference voltage at an intermediate branch of its output stage, between two series connected resistors. Since resistors are subject to process variations and resistance variance over temperature, the sub-bandgap reference voltage produced is subject these variations.

Therefore, further development in the area of sub-bandgap reference voltage generators is still needed.

SUMMARY

A first aspect disclosed herein is a circuit including a reference current generator, a voltage generator, and a differential amplifier. The reference current generator is configured to generate a reference current that is proportional to absolute temperature. The voltage generator is configured to generate an input voltage from the reference current, with the input voltage being complementary to absolute temperature. The differential amplifier is biased by a current derived from the reference current and has an input configured to receive the input voltage. The differential amplifier is configured to generate a voltage proportional to absolute temperature summed with the input voltage that is complementary to absolute temperature to thereby produce a temperature insensitive output reference voltage.

A second aspect disclosed herein is a sub-bandgap reference voltage generator including first, second, and third circuits. The first circuit is configured to generate a current proportional to absolute temperature as a function of a difference between base to emitter voltages of first and second bipolar junction transistors. The second circuit is configured to generate a voltage complementary to absolute temperature by applying the current proportional to absolute temperature through a plurality of field effect transistors coupled in series between the base to emitter voltage of the second bipolar junction transistor and ground, thereby producing the voltage complementary to absolute temperature at a node between given adjacent ones of the plurality of field effect transistors. The third circuit is configured to generate a sub-bandgap reference voltage by using the current proportional to absolute temperature to bias a unity gain amplifier receiving the voltage complementary to absolute temperature as input to generate a voltage proportional to absolute temperature, and summing the voltage proportional to absolute temperature with the voltage complementary to absolute temperature.

A method aspect disclosed herein includes generating a reference current that is proportional to absolute temperature, and generating an input voltage from the reference current, with the input voltage being complementary to absolute temperature. The method also includes generating a voltage proportional to absolute temperature to be summed with the input voltage to produce a temperature insensitive output reference voltage.

DETAILED DESCRIPTION

The following disclosure enables a person skilled in the art to make and use the subject matter disclosed herein. The general principles described herein may be applied to embodiments and applications other than those detailed above without departing from the spirit and scope of this disclosure. This disclosure is not intended to be limited to the embodiments shown, but is to be accorded the widest scope consistent with the principles and features disclosed or suggested herein.

Figure 1:
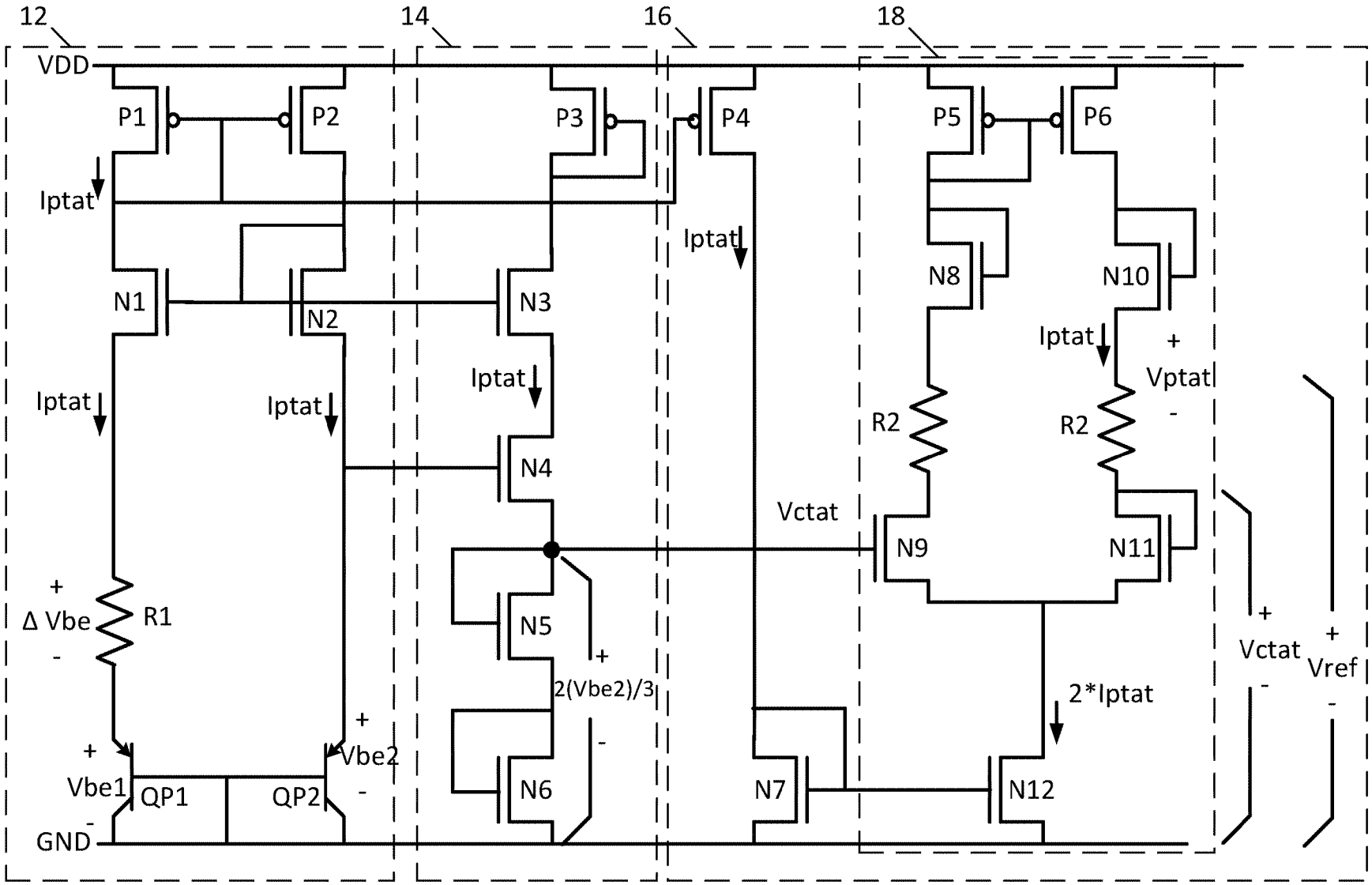
FIG. 1 is a detailed schematic diagram of a sub-bandgap reference voltage generator in accordance with this disclosure.

A sub-bandgap reference voltage (Vref) generator is now described with reference to FIG. 1. For ease of explanation and understanding, the Vref generator will be described in terms of three constituent circuit blocks 12, 14, and 16. Block 12 is responsible for generation of a current proportional to absolute temperature Iptat, while block 14 is responsible for generation of a voltage complementary to absolute temperature Vctat, which in turn is used to control a differential amplifier 18 within block 16 to generate Vref.

In detail, block 12 is a constant transconductance circuit, with PMOS transistors P1 and P2 arranged as a current mirror, with the sources of PMOS transistors P1 and P2 being coupled to a supply node VDD, and the gates of PMOS transistors P1 and P2 being coupled to the drain of PMOS transistor P1. NMOS transistors N1 and N2 are also arranged as a current mirror, with the drain of NMOS transistor N1 coupled to the drain of PMOS transistor P1, the drain of NMOS transistor N2 coupled to the drain of PMOS transistor P2, and the gates of NMOS transistors N1 and N2 coupled to the drain of NMOS transistor N2. The source of NMOS transistor N1 is coupled to the emitter of diode coupled PNP transistor QP1 through resistor R1, while the source of NMOS transistor N2 is directly coupled to the emitter of diode coupled PNP transistor QP2.

Once operating in a stable state, the current mirror formed from PMOS transistors P1 and P2 enforces equality in the drain currents of NMOS transistors N1 and N2, and therefore equality in the gate to source voltages Vgs of NMOS transistors N1 and N2. This results in the base to emitter voltage Vbe2 of PNP transistor QP2 being applied at the source of NMOS transistor N1. Since resistor R1 is between the voltages Vbe2 and Vbe1 (the base to emitter voltage of PNP transistor QP1), the voltage across resistor R1 is Vbe2−Vbe1, which can be referred to as ΔVbe. The resulting current Iptat applied through resistor R1 is proportional to absolute temperature and flows into PNP transistor QP2 due to the current mirror formed from NMOS transistors N1 and N2. Iptat can be calculated as:

$$Iptat=\Delta Vbe/R1$$

Block 14 is comprised of a single branch, and includes diode coupled PMOS transistor P3 having its source coupled to the supply node Vdd and its gate coupled to its drain. NMOS transistor N3 has its drain coupled to the drain of PMOS transistor P3, and its gate coupled to the gates of NMOS transistors N1 and N2 in a current mirroring relationship. NMOS transistor N4 has its gate coupled to the source of NMOS transistor N2 and is thus biased by the voltage Vbe2. The drain of NMOS transistor N4 is coupled to the source of NMOS transistor N3.

NMOS transistors N5 and N6 are diode connected. In particular, NMOS transistor N5 has its drain coupled to the source of NMOS transistor N4 and its gate coupled to its drain. NMOS transistor N6 has its drain coupled to the source of NMOS transistor N5, its gate coupled to its drain, and its source coupled to ground.

In operation, the source of NMOS transistor N3 is approximately equal to the source of NMOS transistor N2, which results in the drain voltage of NMOS transistor N4 being approximately at Vbe2, which it is noted is also the gate voltage of NMOS transistor N4. As the NMOS transistors N4, N5 and N6 all are carrying same current, the gate to source voltages (Vgs) of NMOS transistors N4, N5, and N6 will therefore be the same Since the voltage from the gate of NMOS transistor N4 to the source of NMOS transistor N6 (which is at ground) is Vbe2, and since the Vgs for each of the NMOS transistors N4, N5, and N6 is the same, the voltage from the drain of NMOS transistor N5 to ground will be 2Vbe2/3, which is a voltage complementary to absolute temperature, and can be referred to as Vctat. The purpose of using block 14 to produce Vctat, as opposed to a resistive divider, is to avoid loading the components of block 12.

Block 16 includes PMOS transistor P4 having its source coupled to the supply node VDD and its gate coupled to the gates of PMOS transistors P1 and P2 in a current mirroring relationships. Block 16 also includes a current mirror formed from NMOS transistors N7 and N12. The drain of NMOS transistor N7 is coupled to its gate and to the drain of PMOS transistor P4, and the source of NMOS transistor N7 is coupled to ground.

Block 16 also includes a differential amplifier 18 in a unity gain configuration. The differential amplifier 18 is comprised of PMOS load transistors P5 and P6, diode coupled NMOS transistors N8 and N10, two resistors R2, NMOS differential input transistors N9 and N11, and a tail current source formed from NMOS transistor N12.

In greater detail, NMOS transistor N12 has its gate coupled to the gate and drain of NMOS transistor N7, and its source coupled to ground. PMOS transistors P5 and P6 have their sources coupled to the supply node VDD and their gates coupled to one another. The drain of PMOS transistor P5 is coupled to its gate. NMOS transistor N8 has its drain coupled to the drain of PMOS transistor P5 and has its gate coupled to its drain. A resistor R2 is coupled between the source of NMOS transistor N8 and the drain of NMOS transistor N9. NMOS transistor N9 has its gate biased by Vctat and its source coupled to the drain of NMOS transistor N12. NMOS transistor N10 has its drain coupled to the drain of PMOS transistor P6 and its gate coupled to its drain. Another resistor R2 (also denoted R2 to show that both of these resistors have the same resistance) is coupled between the source of NMOS transistor N10 and the drain of NMOS transistor N11. NMOS transistor N11 has its gate coupled to its drain and its source coupled to the drain of NMOS transistor N12.

In operation, since PMOS transistor P4 is in a current mirroring relationship with PMOS transistors P1 and P2, it emits the current Iptat from its drain. The current mirror formed from NMOS transistors N7 and N12 receives the current Iptat from PMOS transistor P4 as input, and due to a 2:1 mirroring ratio, draws current 2*Iptat from the tail of the differential amplifier 18. Since the left and right branches of the differential amplifier 18 are balanced, this means that the current Iptat flows through each branch. Therefore, Iptat is applied through both resistors R2, generating a voltage proportional to absolute temperature Vptat. Vptat can be calculated as:

$$Vptat=Iptat*R2$$

Since the differential amplifier 18 is in a unity gain configuration with its output (at the drain of NMOS transistor N11) coupled to its inverting input (the gate of NMOS transistor N11), the voltage Vctat is produced at the drain of NMOS transistor N11. By summing the voltage Vctat with the voltage Vptat, the temperature dependence is canceled out, and the sub-bandgap voltage Vref is produced. Mathematically, it can be noted that since Vptat=Iptat*R2 and since Iptat=ΔVbe/R1, through substitution, Vptat can be represented as (ΔVbe/R1)*R2, and thus:

$$Vptat=(R2/R1)*\Delta Vbe$$

Note that since Vctat=2Vbe2/3, Vref can thus be calculated as:

$$Vref=2Vbe2/3+R2/R1\ \Delta Vbe$$

It is noted that diode coupled NMOS transistors N8 and N10 serve to provide adequate headroom between Vref and VDD such that the current mirror formed from PMOS transistors P5 and P6 operates properly.

Figure 2:
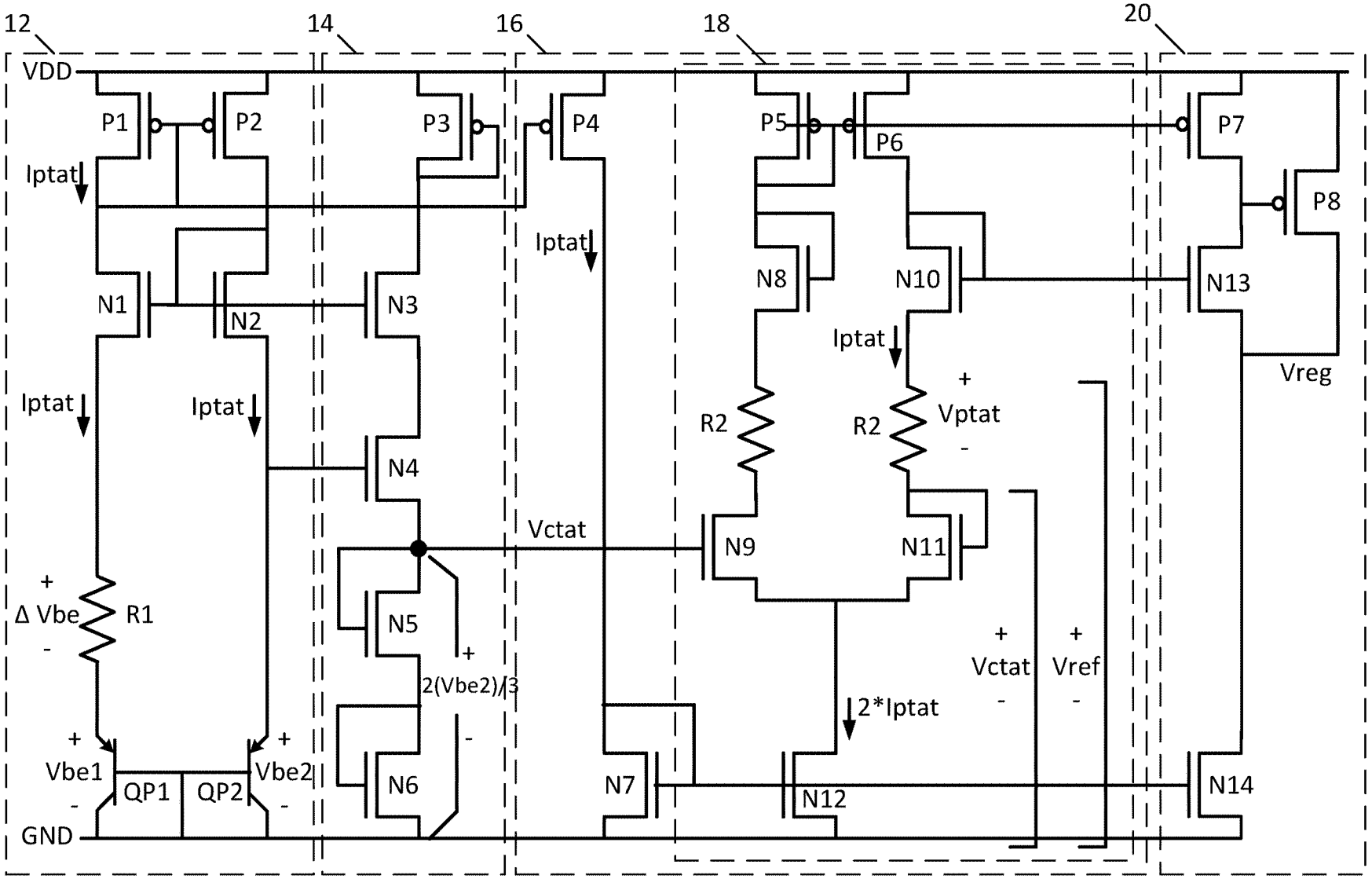
FIG. 2 is a detailed schematic diagram of an additional embodiment of a sub-bandgap reference voltage generator combined with a super source follower to create a voltage regulator, in accordance with this disclosure.

With additional reference to FIG. 2, source follower circuitry 20 can be used to generate a regulator voltage Vreg from the reference voltage Vref. The blocks 12, 14, 16, and 18 shown in FIG. 2 are the same as in FIG. 1 and need no further description, so the following will focus on the source follower circuitry 20.

The source follower circuitry 20 includes PMOS transistor P7 having its source coupled to the supply node VDD, and its gate coupled to the gates of PMOS transistors P5 and P6 in a current mirror relationship. PMOS transistor P8 has its source coupled to the supply node VDD and its gate coupled to the drain of PMOS transistor P7. NMOS transistor N13 has its drain coupled to the gate of PMOS transistor P8, forming a super source follower. NMOS transistor N14 has its drain coupled to the source of NMOS transistor N13, its source coupled to ground, and its gate coupled to to the gates of NMOS transistors N7 and N12 in a current mirroring relationship. This produces a regulated voltage Vreg at the source of NMOS transistor N13 and drain of PMOS transistor P8. This regulated voltage can be calculated as:

$$Vreg=Vref+(VgsN10-VgsN13)$$

Advantages provided by the Vref generator include a low voltage head-room requirement, and easy scaling of Vref. Vref can be scaled by changing the number of diode coupled NMOS transistors in block 14, for example, as the use of two as shown sets the ratio of ⅔ as described. Other numbers will produce different ratios. Vref can also be scaled by changing the ratio of R2 to R1. Moreover, the components of this Vref generator can be low current components.

While the disclosure has been described with respect to a limited number of embodiments, those skilled in the art, having benefit of this disclosure, will appreciate that other embodiments can be envisioned that do not depart from the scope of the disclosure as disclosed herein. Accordingly, the scope of the disclosure shall be limited only by the attached claims.

The invention claimed is:

1. A circuit, comprising:

a reference current generator circuit configured to generate a reference current that is proportional to absolute temperature, wherein the reference current generator circuit generates the reference current as a function of a difference between bias voltages of first and second transistors;

a voltage generator configured to generate an input voltage from the reference current, wherein the input voltage is complementary to absolute temperature, wherein the voltage generator generates the input voltage by applying the reference current that is proportional to absolute temperature through a plurality of transistors coupled in series between the bias voltage of the second transistor and ground, with the input voltage that is complementary to absolute temperature being generated at a node between given adjacent ones of the plurality of transistors; and a differential amplifier biased by a current derived from the reference current and having an input configured to receive the input voltage and including a resistor configured to generate a voltage proportional to absolute temperature summed with the input voltage that is complementary to absolute temperature to thereby produce a temperature insensitive output reference voltage.

2. The circuit of claim 1, wherein the plurality of transistors comprises a plurality of diode connected field effect transistors.

3. The circuit of claim 2, wherein the plurality of transistors includes a transistor mirroring the reference current to the plurality of diode connected field effect transistors; and wherein the input voltage is produced at a tap between the transistor and the plurality of diode connected field effect transistors.

4. The circuit of claim 3, wherein the reference current generator circuit generates the reference current as a function of a difference between base to emitter voltages of first and second bipolar junction transistors.

5. The circuit of claim 1, wherein the differential amplifier includes first and second branches in balance and being biased by a current dependent on the reference current to thereby generate a voltage proportional to absolute temperature.

6. The circuit of claim 5, wherein:

the differential amplifier receives the input voltage from the voltage generator at an input, and reproduces that input voltage at an output;

the resistor has a first terminal to receive the current derived from the reference current and a second terminal coupled to the output of the differential amplifier;

a voltage between the first and second terminals of the resistor is the voltage proportional to absolute temperature; and a voltage at the first terminal of the resistor is the temperature insensitive output reference voltage.

7. A sub-bandgap reference voltage generator, comprising:

a first circuit configured to generate a current proportional to absolute temperature as a function of a difference between base to emitter voltages of first and second bipolar junction transistors;

a second circuit configured to generate a voltage complementary to absolute temperature by applying the current proportional to absolute temperature through a plurality of field effect transistors coupled in series between the base to emitter voltage of the second bipolar junction transistor and ground, thereby producing the voltage complementary to absolute temperature at a node between given adjacent ones of the plurality of field effect transistors; and a third circuit configured to generate a sub-bandgap reference voltage by using the current proportional to absolute temperature to bias a unity gain amplifier receiving the voltage complementary to absolute temperature as input to generate a voltage proportional to absolute temperature and summing the voltage proportional to absolute temperature with the voltage complementary to absolute temperature.

8. The sub-bandgap reference voltage generator of claim 7, wherein:

the second circuit comprises a first field effect transistor coupled to the first circuit and configured to mirror the current proportional to absolute temperature to the plurality of field effect transistors; and wherein a first of the plurality of field effect transistors has a drain coupled to receive the current proportional to absolute temperature from the first field effect transistor and a gate biased by the base to emitter voltage of the second bipolar junction transistor.

9. The sub-bandgap reference voltage generator of claim 8, wherein:

a second of the plurality of field effect transistors has a drain coupled to a source of the first of the plurality of field effect transistors and a gate coupled to its drain; and the node is between the source of the first of the plurality of field effect transistors and the drain of the second of the plurality of field effect transistors.

10. The sub-bandgap reference voltage generator of claim 9, wherein a third of the plurality of field effect transistors has a drain coupled to a source of the second of the plurality of field effect transistors, a source coupled to ground, and a gate coupled to its drain.

11. The sub-bandgap reference voltage generator of claim 10, wherein the second circuit further comprises a diode coupled field effect transistor coupled between a supply node and the first field effect transistor.

12. The sub-bandgap reference voltage generator of claim 11, wherein:

the first bipolar junction transistor has a base and a collector coupled to ground;

the second bipolar junction transistor has a base and a collector coupled to ground; and the first circuit comprises:

a first PMOS transistor having a source coupled to the supply node, a drain, and a gate coupled to its drain;

a second PMOS transistor having a source coupled to the supply node, a drain, and a gate coupled to the gate of the first PMOS transistor;

a first NMOS transistor having a drain coupled to the drain of the first PMOS transistor, a source, and a gate;

a second NMOS transistor having a drain coupled to the drain of the second PMOS transistor, a source coupled to an emitter of the second bipolar junction transistor, and a gate coupled to its drain and to the gate of the first NMOS transistor; and a resistor coupled between the source of the first NMOS transistor and the emitter of the first bipolar junction transistor.

13. The sub-bandgap reference voltage generator of claim 12, wherein the first field effect transistor of the second circuit has a gate coupled to the gates of the first and second NMOS transistors; and wherein the gate of the first of the plurality of field effect transistors is coupled to the source of the second NMOS transistor and the emitter of the second bipolar junction transistor.

14. The sub-bandgap reference voltage of claim 7, wherein the unity gain amplifier comprises first and second branches in balance and being biased by a current dependent on the current proportional to absolute voltage to thereby reproduce the voltage proportional to absolute temperature.

15. The sub-bandgap reference voltage generator of claim 7, wherein the unity gain amplifier comprises:

a first branch having:

a first transistor having a first conduction terminal coupled to a supply node, a second conduction terminal, and a control terminal coupled to its second conduction terminal;

a second transistor having a first conduction terminal coupled to the second conduction terminal of the first transistor, a control terminal coupled to its first conduction terminal, and a second conduction terminal;

a third transistor having a control terminal biased by the voltage complementary to absolute temperature, a first conduction terminal, and a second conduction terminal coupled to a tail current source; and a resistor coupled between the second conduction terminal of the second transistor and the first conduction terminal of the third transistor.

16. The sub-bandgap reference voltage generator of claim 15:

wherein the unity gain amplifier further comprises a second branch having:

a first transistor having a first conduction terminal coupled to the supply node, a second conduction terminal, and a control terminal coupled to the control terminal of the first branch;

a second transistor having a first conduction terminal coupled to the second conduction terminal of the first transistor of the second branch, a control terminal coupled to its first conduction terminal, and a second conduction terminal;

a third transistor having a first conduction terminal, a control terminal coupled to its first conduction terminal, and a second conduction terminal coupled to the tail current source; and a resistor coupled between the second conduction terminal of the second transistor of the second branch and the first conduction terminal of the third transistor of the second branch;

wherein the tail current source is configured to draw twice the current proportional to absolute temperature;

wherein the first and second branches are balanced such that an effect of the tail current source drawing twice the current proportional to absolute temperature is to draw the current proportional to absolute temperature through each of the first and second branches;

wherein the current proportional to absolute temperature flowing through the resistor of the second branch generates the voltage proportional to absolute temperature;

wherein the first conduction terminal of the third transistor of the second branch forms an output of the unity gain amplifier that reproduces the voltage complementary to absolute temperature; and wherein the sub-bandgap reference voltage is produced at the second conduction terminal of the second transistor of the second branch.

17. The sub-bandgap reference voltage generator of claim 16, wherein the tail current source comprises a 2:1 current mirror configured to receive the current proportional to absolute temperature as input and to draw twice the current proportional to absolute temperature as output.

18. The sub-bandgap reference voltage generator of claim 7, further comprising a fourth circuit configured to generate a regulated voltage from the sub-bandgap reference voltage.

19. The sub-bandgap reference voltage generator of claim 18, wherein the fourth circuit comprises a super source follower coupled between first and second current sources and configured to receive the sub-bandgap reference voltage as input.

20. A method comprising:

generating a reference current that is proportional to absolute temperature, wherein the reference current is generated as a function of a difference between a first transistor bias voltage and a second transistor bias voltage;

generating an input voltage from the reference current, the input voltage being complementary to absolute temperature, wherein generating the input voltage comprises applying the reference current through a plurality of transistors coupled in series between the second transistor bias voltage and ground to produce an input voltage at a node between given adjacent ones of the plurality of transistors; and generating a voltage proportional to absolute temperature summed with the input voltage to produce a temperature insensitive output reference voltage.

21. The method of claim 20, wherein generating the input voltage further comprises mirroring the reference current from a mirror transistor of the plurality of transistors to a plurality of diode coupled field effect transistors of the plurality of transistors such that the input voltage is produced at the node, the node being coupled to a drain of one of the plurality of diode coupled field effect transistors.

22. The method of claim 21, wherein the reference current is generated as a function of a difference between a base to emitter voltage of a first bipolar junction transistor and a bas to emitter voltage of a second bipolar junction transistor.

* * * * *